US011754947B2

(12) United States Patent
Yoshizawa et al.

(10) Patent No.: US 11,754,947 B2
(45) Date of Patent: Sep. 12, 2023

(54) TONER CONTAINER INCLUDING A ROTATABLE CONTAINER BODY, A GEAR, AND A HELD PORTION

(71) Applicants: Hideo Yoshizawa, Kanagawa (JP); Kei Saito, Tokyo (JP); Yuki Oshikawa, Kanagawa (JP)

(72) Inventors: Hideo Yoshizawa, Kanagawa (JP); Kei Saito, Tokyo (JP); Yuki Oshikawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/706,608

(22) Filed: Mar. 29, 2022

(65) Prior Publication Data

US 2022/0317595 A1 Oct. 6, 2022

(30) Foreign Application Priority Data

Mar. 31, 2021 (JP) ..... 2021-059132
Feb. 4, 2022 (JP) ..... 2022-016150

(51) Int. Cl.
*G03G 15/08* (2006.01)

(52) U.S. Cl.
CPC ..... *G03G 15/0887* (2013.01)

(58) Field of Classification Search
CPC ..... G03G 15/0887; G03G 15/0872
See application file for complete search history.

(56) References Cited

U.S. PATENT DOCUMENTS

2017/0153572 A1* 6/2017 Takahashi ..... G03G 15/553
2020/0183303 A1 6/2020 Kikuchi et al.
2020/0292963 A1 9/2020 Adachi et al.
2021/0003942 A1 1/2021 Kikuchi et al.
2021/0088935 A1 3/2021 Kikuchi et al.

* cited by examiner

*Primary Examiner* — Walter L Lindsay, Jr.
*Assistant Examiner* — Geoffrey T Evans
(74) *Attorney, Agent, or Firm* — XSENSUS LLP

(57) ABSTRACT

A toner container includes a container body, a gear, a held portion, an information storage device, a holding portion, and a connecting portion. The container body is rotatable around a rotation axis. The gear is disposed on a leading end of the toner container in the attaching direction of the toner container. The held portion is disposed such that the gear is exposed on the leading end in the attaching direction. The information storage device communicates with the body of the image forming apparatus. The holding portion is held by the held portion via the connecting portion. The information storage device, the holding portion, and the connecting portion are disposed at oblique positions excluding positions on a horizontal line and a vertical line. The connecting portion covers a part of the gear in a rotation direction and includes a rib-shaped portion that connects the held portion and the holding portion.

16 Claims, 6 Drawing Sheets

TONER CONTAINER INCLUDING A ROTATABLE CONTAINER BODY, A GEAR, AND A HELD PORTION

CROSS-REFERENCE TO RELATED APPLICATIONS

This patent application is based on and claims priority pursuant to 35 U.S.C. § 119(a) to Japanese Patent Application Nos. 2021-059132, filed on Mar. 31, 2021, and 2022-016150, filed on Feb. 4, 2022, in the Japan Patent Office, the entire disclosure of which is hereby incorporated by reference herein.

BACKGROUND

Technical Field

Embodiments of this disclosure relate to a toner container to store toner and an image forming apparatus incorporating the same.

Related Art

Conventionally, as an example of an image forming apparatus such as a copier, a printer, a facsimile machine, and multifunction peripherals (MFPs) including at least two of the copier, the printer, and the facsimile machine, an image forming apparatus is widely known in which a cylindrical toner container is detachably attached.

SUMMARY

In an embodiment of the present disclosure, there is provided a toner container that includes a container body, a gear, a held portion, an information storage device, a holding portion, and a connecting portion. The container body is rotatable around a rotation axis. The gear is disposed on a leading end of the toner container in the attaching direction of the toner container and is rotatable together with the container body. The held portion covers a part of the container body and is disposed such that the gear is exposed on the leading end in the attaching direction. The held portion is held by the body of the image forming apparatus in a non-rotating manner. The information storage device communicates with the body of the image forming apparatus in a state where the toner container is attached to the body of the image forming apparatus. The holding portion holds the information storage device at a position closer to a leading edge of the toner container than the gear in the attaching direction and is held by the held portion via the connecting portion. The information storage device, the holding portion, and the connecting portion are disposed at oblique positions excluding positions on a horizontal line and a vertical line passing through the rotation axis when viewed in a cross section orthogonal to the rotation axis in the state where the toner container is attached to the body of the image forming apparatus. The connecting portion covers a part of the gear in a rotation direction of the gear and includes a rib-shaped portion that connects the held portion and the holding portion.

In another embodiment of the present disclosure, there is provided an image forming apparatus that includes the toner container and the body. The toner container is detachably attached to the body.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
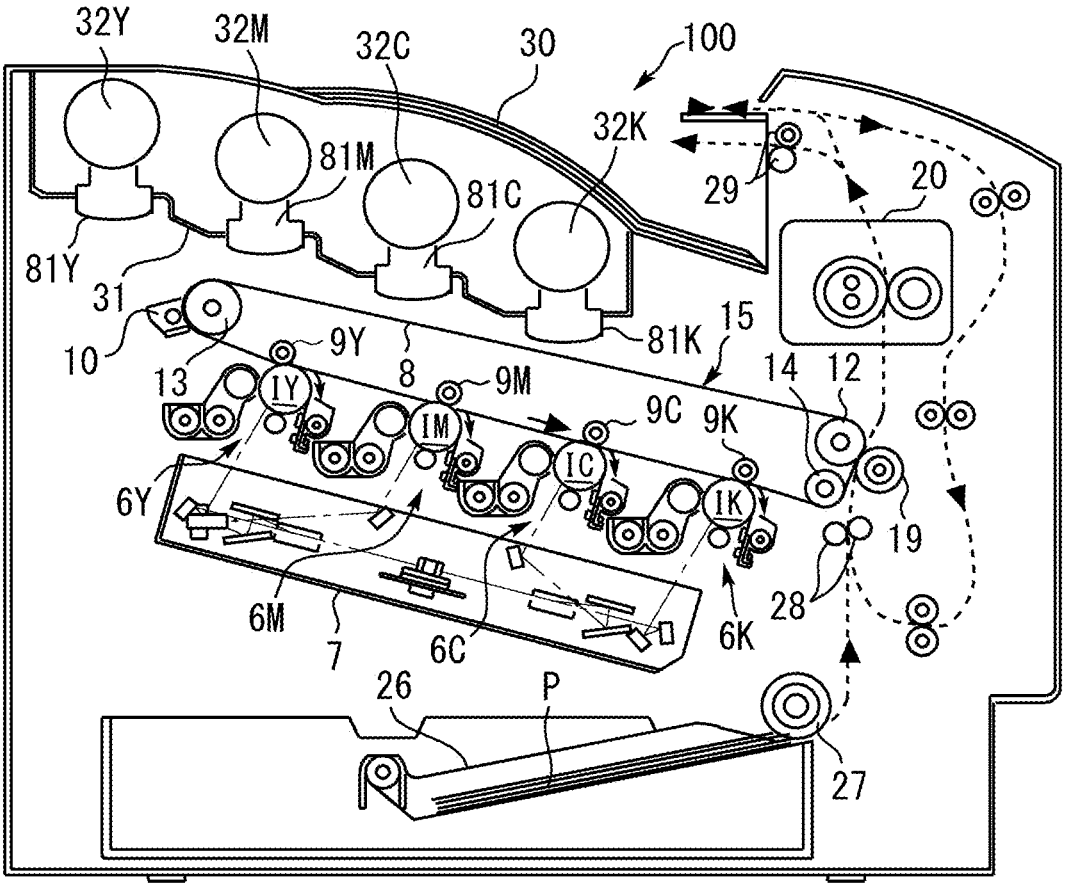
FIG. 1 is a diagram illustrating an overall configuration of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Embodiments of the present disclosure are described in detail with reference to drawings. In the drawings, the same or corresponding parts are denoted by the same reference numerals, and redundant description thereof are simplified or omitted as appropriate.

Figure 2:
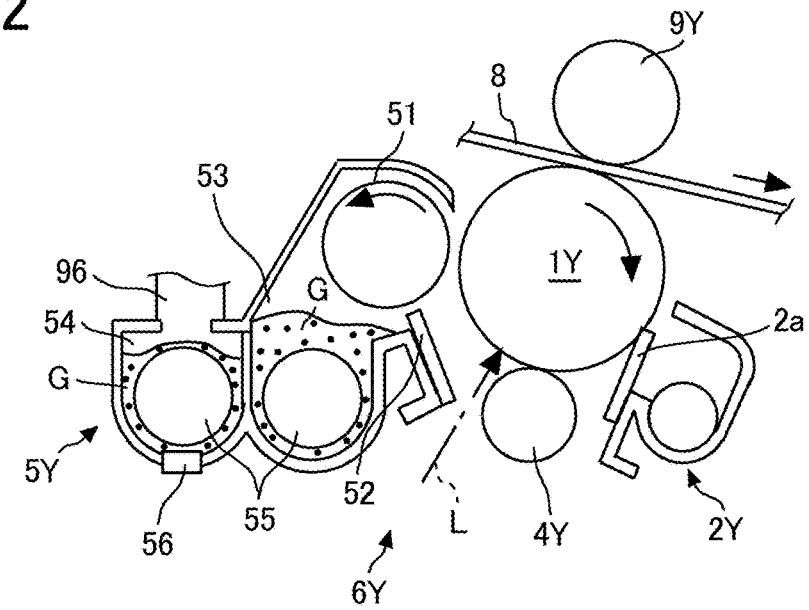
FIG. 2 is a cross-sectional view of an image forming device of the image forming apparatus in FIG. 1.
Figure 3:
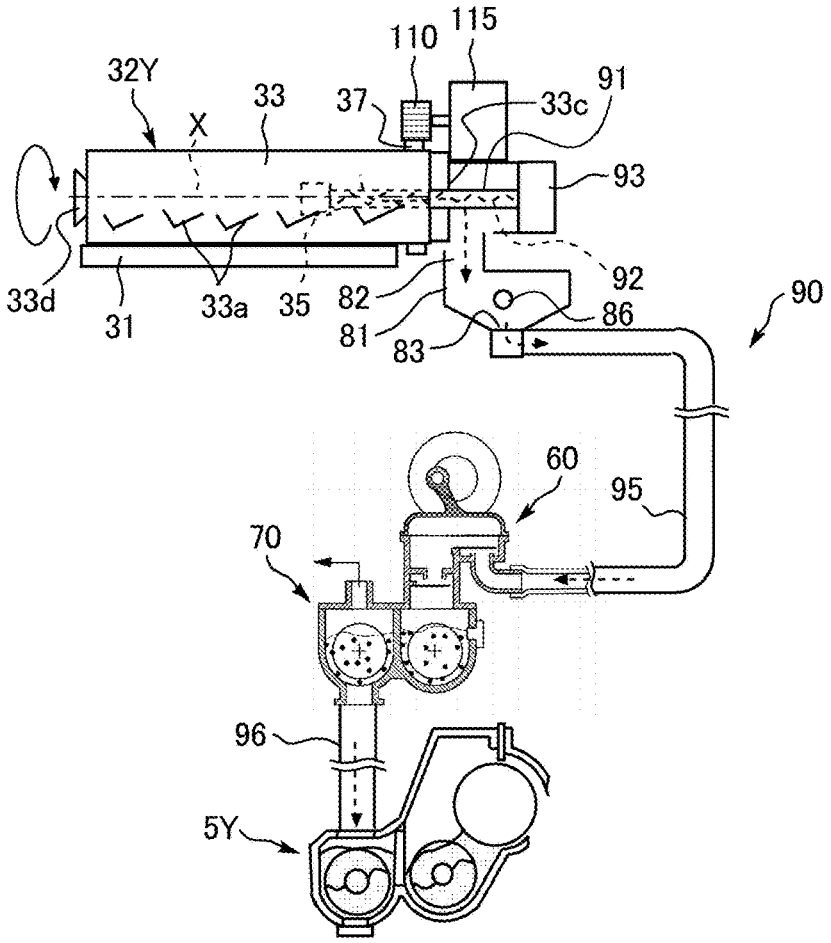
FIG. 3 is a schematic view of a toner supply device of the image forming apparatus and the vicinity thereof.

With reference to FIGS. 1 to 3, an overall configuration and operation of an image forming apparatus 100 are described below. FIG. 1 is a schematic view of a printer as the image forming apparatus 100. FIG. 2 is an enlarged view of an image forming device of the image forming apparatus 100. FIG. 3 is a schematic view of a toner supply device and the vicinity thereof. As illustrated in FIG. 1, the image forming apparatus 100 includes an installation section 31 (serving as a toner container rack) in an upper portion of a body of the image forming apparatus 100. Substantially cylindrical toner containers 32Y, 32M. 32C, and 32K are detachably (replaceably) attached to the installation section 31. The four toner containers 32Y, 32M, 32C, and 32K correspond to four colors, that is, yellow, magenta, cyan, and black, respectively. Below the toner containers 32Y, 32M, 32C, and 32K, hoppers 81Y. 81M, 81C, and 81K of toner supply devices are disposed, respectively. An intermediate transfer unit 15 is disposed below the installation section 31. Image forming devices 6Y, 6M, 6C, and 6K are arranged side by side, facing an intermediate transfer belt 8 of the intermediate transfer unit 15 to form toner images of yellow, magenta, cyan, and black, respectively.

With reference to FIG. 2, the image forming device 6Y for yellow includes a photoconductor drum 1Y (serving as an image bearer), a charging device 4Y, a developing device 5Y, a cleaning device 2Y, and a discharging device that are disposed around the photoconductor drum 1Y. Image forming processes (i.e., charging, exposure, development, transfer, cleaning, and discharging processes) are performed on the photoconductor drum 1Y, and thus a yellow toner image is formed on the surface of the photoconductor drum 1Y.

The other three image forming devices 6M, 6C, and 6K have substantially similar configuration to that of the image forming device 6Y for yellow except for the color of toner used therein and form magenta, cyan, and black toner images, respectively. Therefore, only the image forming device 6Y for yellow is described below and descriptions of the other three image forming devices 6M, 6C, and 6K are omitted to avoid redundancy.

With reference to FIG. 2, the photoconductor drum 1Y is driven by a motor to rotate clockwise in FIG. 2. The charging device 4Y uniformly charges the surface of the photoconductor drum 1Y (a charging process). When the surface of the photoconductor drum 1Y reaches a position at which the surface of the photoconductor drum 1Y is irradiated with laser beam L emitted from an exposure device 7 (a writing device, see FIG. 1), the photoconductor drum 1Y is scanned with the laser beam L. Thus, an electrostatic latent image corresponding to yellow is formed on the photoconductor drum 1Y (an exposure process).

When the surface of the photoconductor drum 1Y reaches a position facing the developing device 5Y, the electrostatic latent image is developed with toner into a yellow toner image (a development process). When the surface of the photoconductor drum 1Y bearing the toner image reaches a position facing a primary transfer roller 9Y via the intermediate transfer belt 8, the toner image on the photoconductor drum 1Y is transferred onto the intermediate transfer belt 8 (a primary transfer process). After the primary transfer process, a slight amount of untransferred toner remains on the photoconductor drum 1Y.

When the surface of the photoconductor drum 1Y reaches a position facing the cleaning device 2Y, a cleaning blade 2*a* collects the untransferred toner from the photoconductor drum 1Y into the cleaning device 2Y (a cleaning process). Finally, the surface of the photoconductor drum 1Y reaches a position facing the discharging device, and the discharging device removes residual potentials from the photoconductor drum 1Y. Thus, a series of image forming processes performed on the surface of the photoconductor drum 1Y is completed.

Note that the other image forming devices 6M, 6C, and 6K perform the series of image forming processes described above in substantially the same manner as the image forming device 6Y for yellow. That is, the exposure device 7 disposed below the image forming devices 6M, 6C, and 6K irradiates photoconductor drums 1M, 1C, and 1K of the image forming devices 6M, 6C, and 6K, respectively, with the laser beams L based on image data. Specifically, in the exposure device 7, a light source emits the laser beam L, which is deflected by a polygon mirror rotated. The laser beam L then reaches the photoconductor drum 1 via multiple optical elements. Thus, the exposure device 7 scans the surface of each of the photoconductor drums 1M, 1C, and 1K with the laser beam L. Then, toner images formed on the photoconductor drums 1Y, 1M, 1C, and 1K through the development process are transferred and superimposed onto the intermediate transfer belt 8. Thus, a color toner image is formed on the intermediate transfer belt 8.

The intermediate transfer unit 15 includes the intermediate transfer belt 8, four primary transfer rollers 9Y, 9M, 9C, and 9K, a secondary transfer counter roller 12, a cleaning backup roller 13, a tension roller 14, and an intermediate transfer cleaning device 10. The intermediate transfer belt 8 is extended and supported by the secondary transfer counter roller 12, the cleaning backup roller 13, and the tension roller 14. The secondary transfer counter roller 12 serves as a driving roller to rotate the intermediate transfer belt 8 in the direction (counterclockwise) indicated by an arrow in FIG. 1.

Each of the four primary transfer rollers 9Y, 9M, 9C, and 9K nip the intermediate transfer belt 8 with the corresponding one of the photoconductor drums 1Y, 1M, 1C, and 1K to form an area of contact, herein called a primary transfer nip, between the intermediate transfer belt 8 and the corresponding one of the photoconductor drums 1Y, 1M, 1C, and 1K. A primary-transfer bias opposite in polarity to toner is applied to the primary transfer rollers 9Y, 9M. 9C, and 9K. The intermediate transfer belt 8 travels in the direction (counterclockwise) indicated by an arrow in FIG. 1 and sequentially passes through the primary transfer nips of the primary transfer rollers 9Y, 9M, 9C, and 9K. Then, the single-color toner images on the photoconductor drums 1Y, 1M, 1C, and 1K, having the respective colors, are primarily transferred to and superimposed onto the intermediate transfer belt 8, thereby forming the multicolor toner image.

Subsequently, the intermediate transfer belt 8, which the toner images of the respective colors are transferred to and superimposed onto, reaches a position opposite a secondary transfer roller 19. At this position, the intermediate transfer belt 8 is nipped between the secondary transfer counter roller 12 and the secondary transfer roller 19 to form a secondary transfer nip. The toner images of four colors formed on the intermediate transfer belt 8 are transferred onto a sheet P such as a sheet of paper conveyed to the position of the secondary transfer nip (a secondary transfer process). At this time, the untransferred toner, untransferred on the sheet P, may remain on the intermediate transfer belt 8 as a residual toner.

The surface of the intermediate transfer belt 8 then reaches a position opposite the intermediate transfer cleaning device 10. At the position, the intermediate transfer cleaning device 10 collects the untransferred toner from the intermediate transfer belt 8. Thus, a series of transfer processes performed on the intermediate transfer belt 8 is completed.

The sheet P is conveyed from a sheet feeder 26 disposed in a lower portion of the body of the image forming apparatus 100 to the secondary transfer nip via a feed roller 27 and a registration roller pair 28. Specifically, the sheet feeder 26 contains a stack of multiple sheets P such as sheets of paper stacked on one on another. As the feed roller 27 is rotated counterclockwise in FIG. 1, the feed roller 27 feeds a top sheet P from the stack in the sheet feeder 26 to a roller nip between the registration roller pair 28.

The sheet P conveyed to the registration roller pair 28 (serving as a timing roller pair) temporarily stops at the roller nip between the rollers of the registration roller pair 28 that has stopped rotating. Rotation of the registration roller pair 28 is timed to convey the sheet P toward the secondary transfer nip such that the sheet P meets the color toner image on the intermediate transfer belt 8 at the secondary transfer nip. Thus, the desired color toner image is transferred onto the sheet P.

Subsequently, the sheet P, onto which the color toner image is transferred at the secondary transfer nip, is conveyed to a position of a fixing device 20. Then, at this position, the color toner image transferred to the surface of the sheet P is fixed on the sheet P by heat and pressure of the fixing roller and the pressure roller (a fixing process). Thereafter, the sheet P is conveyed through the rollers of an output roller pair 29 and elected onto an outside of the image forming apparatus 100. The sheets P ejected by the output roller pair 29 to outside the image forming apparatus 100 are sequentially stacked as output images on a stack tray 30. Thus, a series of image forming processes performed by the image forming apparatus 100 is completed.

Next, a detailed description is provided of a configuration and operation of the developing device 5Y of the image forming device 6Y with reference to FIG. 2. The developing device 5Y includes a developing roller 51, a doctor blade 52, two conveying screws 55, and a toner concentration sensor 56. The developing roller 51 faces the photoconductor drum 1Y. The doctor blade 52 faces the developing roller 51. The two conveying screws 55 are disposed within developer housings 53 and 54. The toner concentration sensor 56 detects a concentration of toner in developer G. The developing roller 51 includes magnets and a sleeve. The magnets are secured inside the developing roller 51. The sleeve rotates around the magnets. The developer housings 53 and 54 contain the two-component developer G including carrier (i.e., carrier particles) and toner (i.e., toner particles).

The developing device 5Y described above operates as follows. The sleeve of the developing roller 51 rotates in a direction (counterclockwise) indicated by an arrow in FIG. 2. The developer G is borne on the developing roller 51 by a magnetic field generated by the magnets. As the sleeve rotates, the developer G moves along the circumference of the developing roller 51. The developer G in the developing device 5Y is adjusted so that the ratio of toner (i.e., toner concentration) in the developer G is within a predetermined range. Specifically, the toner supply device 90 (see FIG. 3) serving as a supply device that supplies toner from the toner container 32Y to the developer housing 54 (see FIG. 2) according to the toner consumption in the developing device 5Y.

The toner supplied in the developer housing 54 is stirred and mixed together with the developer G and circulated through the two developer housings 53 and 54 by the two conveying screws 55 (i.e., in a longitudinal direction perpendicular to the plane on which FIG. 2 is illustrated). The toner in the developer G is electrically charged by friction together with the carrier and thus is attracted to the carrier. Both the toner and the carrier are borne on the developing roller 51 due to a magnetic force generated on the developing roller 51. The developer G borne on the developing roller 51 is conveyed in the direction (counterclockwise) indicated by an arrow in FIG. 3 and reaches a position opposite the doctor blade 52Y. The doctor blade 52 adjusts the amount of the developer borne on the developing roller 51 to an appropriate amount. Thereafter, the developer G on the developing roller 51 is conveyed to a position opposite the photoconductor drum 1Y (i.e., a developing area). The toner is attracted to the latent image formed on the photoconductor drum 1Y by an electric field generated in the developing area. Subsequently, as the sleeve rotates, the developer G remaining on the developing roller 51 reaches an upper portion of the developer housing 53 and separates from the developing roller 51.

Next, with reference to FIG. 3, a configuration and operation of the toner supply device 90 are briefly described. The toner supply device 90 rotationally drives a container body 33 of the toner container 32Y (i.e., a powder container) disposed in the installation section 31 in a predetermined direction (i.e., in the direction indicated by an arrow in FIG. 3), discharges the toner as a powder contained in the toner container 32Y to the outside of the toner container 32Y through an opening portion 33*c* (i.e., a toner discharge port), and guides the toner to the developing device 5Y via a sub-hopper 70. The toner supply device 90 includes a toner supply path. To easily understand the configuration of the toner supply device 90 the toner container 32Y, the toner supply device 90, and the developing device 5Y are illustrated in FIG. 3 in different orientations from the actual arrangement. Actually, the longitudinal axes of the toner container 32Y and a part of the toner supply device 90 are perpendicular to the plane on which FIG. 3 is illustrated (see FIG. 1). In addition, the orientations and arrangement of conveying tubes 95 and 96 are also illustrated in a simplified manner.

The toner supply devices 90 supply the color toners contained in the toner containers 32Y, 32M, 32C, and 32K installed in the installation section 31 in the body of the image forming apparatus 100 to the corresponding developing devices 5Y, 5M, 5C, and 5K, respectively. The amount of toner supplied to each developing device 5 is determined based on the amount of toner consumed in the corresponding developing device 5. The four toner supply devices 90 have a similar configuration except the color of the toner used in the image forming processes. Specifically, with reference to FIG. 3, when the toner container 32Y is attached to the installation section 31 of the body of the image forming apparatus 100, a toner conveying nozzle 91 (as a nozzle) of the body of the image forming apparatus 100 pushes and moves a shutter 35 of the toner container 32Y. As a result, the toner conveying nozzle 91 is inserted into the toner container 32Y (i.e., the container body 33) via the opening portion 33*c*. Accordingly, the toner contained in the toner container 32Y can be discharged through the toner conveying nozzle 91. The toner container 32Y includes a gripper 33*d* at the bottom portion (i.e., left in FIG. 3) of the toner container 32Y so that a user easily handles and installs the toner container 32Y in the installation section 31. The gripper 33*d* has an outer diameter smaller than an outer diameter of the container body 33. The user grips the gripper 33*d* to install the toner container 32Y in the installation section 31 and take out the toner container 32Y from the installation section 31.

With reference to FIG. 3, the toner container 32Y includes the container body 33 having a plurality of first projections 33*a* (groove portion) in a rotation axis direction of the container body 33 (i.e., in the left and right direction in FIG. 3, which is in the longitudinal direction of the container body 33 and its attaching or detaching direction). Specifically, the plurality of first projections 33*a* are formed in a concave shape from an outer circumferential surface toward an inner circumferential surface of the container body 33 so that a rotation of the container body 33 conveys the toner in the container body 33 from the left to the right in FIG. 3. The toner conveyed from the left to the right in FIG. 3 inside the container body 33 is discharged to the outside of the toner container 32Y through the toner conveying nozzle 91. A gear 37 that meshes with a drive gear 110 of the body of the image forming apparatus 100 is formed on the outer circumferential surface of the head portion (i.e., right in FIG. 3, which is a leading end in the attaching direction, and a first end in the rotation axis direction) of the container body 33. When the toner container 32Y is installed to the installation section 31, the gear 37 of the container body 33 meshes with the drive gear 110 of the body of the image forming apparatus 100. As a drive motor 115 is driven, a driving force is transmitted to the gear 37 from the drive gear 110, which is installed on a motor shaft of the drive motor 115, thus rotating the container body 33 around a rotation axis X. The drive motor 115 and the drive gear 110 function as a driver to rotate the container body 33. A configuration and operation of the toner container 32Y are described in further detail later.

With reference to FIG. 3, a conveying screw 92 is disposed inside the toner conveying nozzle 9*l*. As a motor 93 rotates the conveying screw 92, the conveying screw 92 conveys the toner flowing into the toner conveying nozzle 91 from an inlet in the toner container 32Y from the left to the right in FIG. 3. Thus, the toner is discharged through an outlet of the toner conveying nozzle 91 to the hopper 81. The hopper 81 is disposed below the outlet of the toner conveying nozzle 91 via a dropping path 82. The toner stored in the hopper 81 is conveyed to the developing device 5 downstream from the hopper 81 by a conveyor.

A conveying mechanism by the conveyor is described with reference to FIG. 3. A suction port 83 is disposed in the bottom of the hopper 81 and coupled to one end of the conveying tube 95 as a tube. The conveying tube 95 is made of a flexible rubber material with low affinity for toner, and the other end of the conveying tube 95 is coupled to a developer pump 60 (i.e., a diaphragm pump). The developer pump 60 is coupled to the developing device 5Y via the sub-hopper 70 and the conveying tube 96. In the toner supply device 90 with such a configuration, the drive motor 115 as the driver rotates the container body 33 of the toner container 32Y to discharge the toner stored in the toner container 32Y to the outside of the toner container 32Y through the toner conveying nozzle 91. The toner discharged from the toner container 32Y falls through the dropping path 82 and is stored in the hopper 81. The developer pump 60 operates to suck the toner stored in the hopper 81 together with air from the suction port 83 and convey the toner from the developer pump 60 to the sub-hopper 70 through the conveying tube 95. The toner conveyed to and stored in the sub-hopper 70 is appropriately supplied into the developing device 5Y via the conveying tube 96. That is, the toner in the toner container 32Y is conveyed in the direction indicated by dashed arrows in FIG. 3. The conveyor is not limited to the above-described configuration, and for example, the toner stored in the hopper 81 may be conveyed directly to the developing device 5Y by a screw disposed in the hopper 81.

A toner sensor 86 is disposed near the suction port 83 and indirectly detects a state in which the toner contained in the toner container 32Y is depleted (i.e., toner end state) or a state in which the toner contained in the toner container 32Y is nearly depleted (i.e., toner near end state). The toner is discharged from the toner container 32Y based on a detection result of the toner sensor 86. For example, a piezoelectric sensor or a transmission optical sensor may be used as the toner sensor 86. The height of the detection surface of the toner sensor 86 is set so that the amount of toner (i.e., a deposition height) deposited above the suction port 83 is a target value. A drive timing and a drive duration of the drive motor 115 are controlled to rotationally drive the toner container 32Y (container body 33) based on the detection result of the toner sensor 86. Specifically, when the toner sensor 86 detects that toner is not deposited on a detection position of the toner sensor 86, the drive motor 115 is driven for a predetermined time. When the toner sensor 86 detects that toner is present on the detection position, the drive motor 115 stops. If the toner sensor 86 continuously detects that toner does not exist at the detection position even when the above-described control is performed repeatedly, a controller of the image forming apparatus determines that the toner stored in the toner container 32Y is depleted (i.e., toner end state) or a state that the toner contained in the toner container 32Y is nearly depleted (i.e., toner near end state).

With reference to FIGS. 4 to 10B, a configuration and operation of the toner container 32Y in the present embodiment are described below. As described above with reference to FIG. 3, the toner container 32Y according to the present embodiment is disposed in the body of the image forming apparatus 100 to be attachable to and detachable from the body in predetermined attaching and detaching directions (i.e., the left and right directions in FIGS. 3 and 4, which are parallel to the rotation axis X (rotation axis direction)). Specifically, the toner container 32Y is attached to the body of the image forming apparatus 100 (installation section 31) from the right side to the left side in FIG. 4. In this case, the leading end of the toner container 32Y in the attaching direction is on the left side of FIG. 4, and the trailing end of the toner container 32Y in the attaching direction is on the right side of FIG. 4. When the toner container 32Y is taken out (detached) from the body of the image forming apparatus 100 (installation section 31), the toner container 32Y moves in the detaching direction opposite the attaching direction.

As described above with reference to FIG. 3, the toner container 32Y in the present embodiment is provided with a held portion 34 (cap) and the shutter 35. The opening portion 33*c* (i.e., toner discharge port) that discharges the toner in the container body 33 is formed at the leading end of the container body 33 in the attaching direction (i.e., the first end in the rotation axis direction and the left side in FIGS. 4 and 5B) of the toner container 32Y. The shutter 35 opens and closes the opening portion 33*c* of the container body 33 in conjunction with attachment of the toner container 32Y to the body of the image forming apparatus 100 (installation section 31) and detachment of the toner container 32Y from the body of the image forming apparatus 100 (installation section 31). That is, when the toner container 32Y is attached to the installation section 31, the shutter 35 that has closed the opening portion 33*c* moves so as to open the opening portion 33*c* in conjunction with the attaching operation. In contrast, when the toner container 32Y is removed from the installation section 31, the shutter 35 that has opened the opening portion 33*c* moves so as to close the opening portion 33*c* in conjunction with the removal operation.

Figure 4:
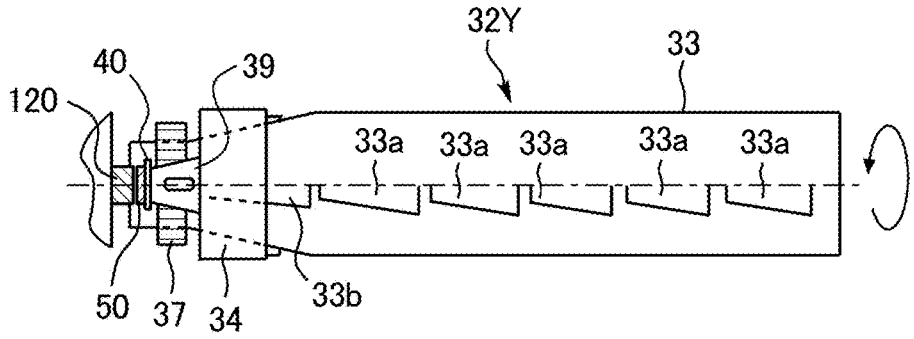
FIG. 4 is a view of a toner container in a longitudinal direction from an oblique direction.
Figure 6A:
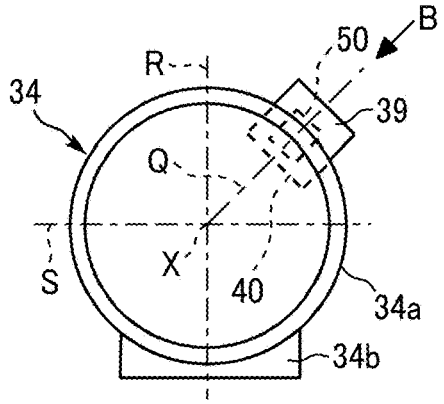
FIG. 6A is a front view of a held portion.
Figure 6B:
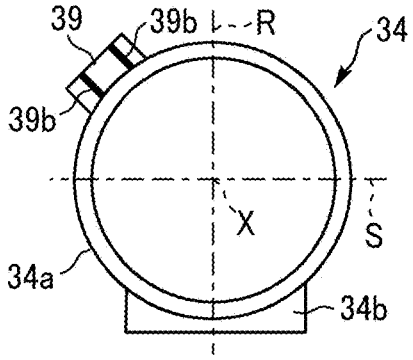
FIG. 6B is a rear view of the held portion.
Figure 7:
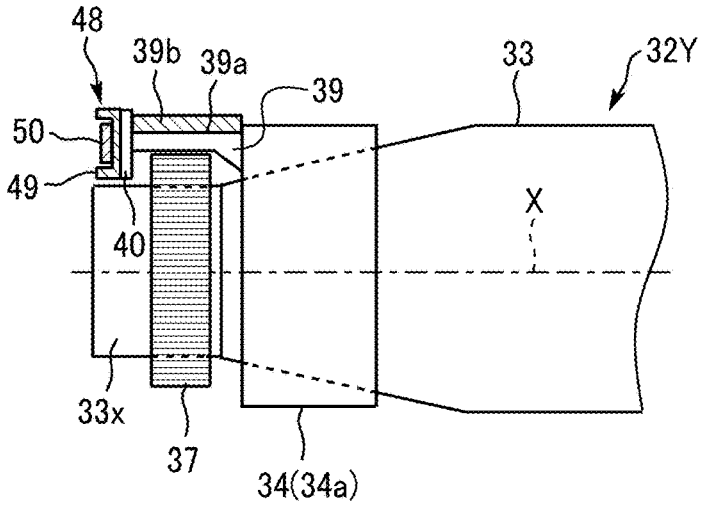
FIG. 7 is a view of a main part of the toner container from a direction orthogonal to an oblique direction (in a direction indicated by an arrow B in FIG. 6A) to a rotation axis direction.
Figure 8:
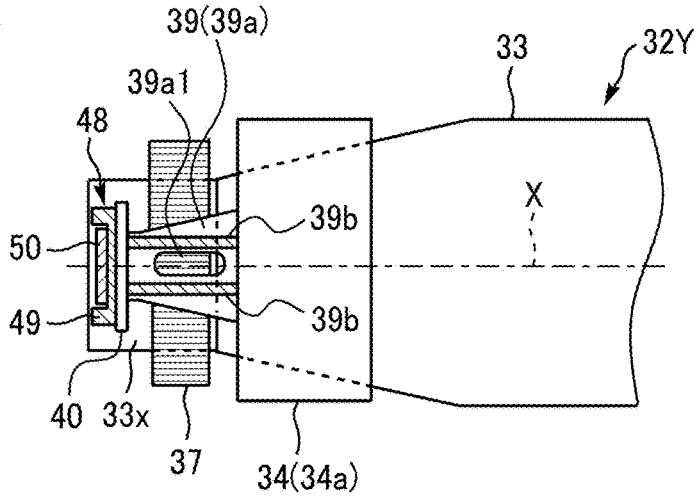
FIG. 8 is a view of the main part of the toner container from the oblique direction (in the direction indicated by an arrow B in FIG. 6A) to the rotation axis direction.

As illustrated in FIG. 4, the held portion 34 is disposed so as to cover a part on the leading end of the container body 33 in the attaching direction (i.e., the first end in the rotation axis direction of the container body 33 and the left side in FIGS. 4, 7, and 8) and is held on the installation section 31 (see FIG. 3) of the body of the image forming apparatus 100 in a non-rotating manner. In other words, the held portion 34 is rotatable relative to the container body 33. As illustrated in FIGS. 6A and 6B, the held portion 34 in the present embodiment mainly includes a large-diameter portion 34*a* (integrated with a connecting portion 39 and a holding portion 40 to be described later) having an outer diameter larger than an outer diameter of the gear 37, and a base 34*b* located below the large-diameter portion 34*a*. The large-diameter portion 34*a* rotatably holds the container body 33. The base 34*b* facilitates sliding of the toner container 32Y when the toner container 32Y is attached to or detached from the image forming apparatus 100 (installation section 31) and is held on the image forming apparatus 10) (installation section 31) in a non-rotating manner.

With reference to FIGS. 4, 7, and 8, a leading-end cylindrical portion 33*x* of the container body 33 includes the gear 37 that is rotatable together with the container body 33 on an outer circumferential surface on the leading end of the container body 33 in the attaching direction (i.e., the first end in the rotation axis direction and the left side in FIG. 4) in the attaching and detaching directions of the toner container 32. When the toner container 32Y is attached to the installation section 31, the gear 37 of the container body 33 meshes with the drive gear 110 (see FIG. 3) of the body of the image forming apparatus 10. Thus, the container body 33 is rotationally driven. In the present embodiment, since the gear 37 has a relatively large outer diameter so as to approximate the outer diameter of the container body 33, the outer diameter of the drive gear 110 (see FIG. 3) of the body of the image forming apparatus 100 is set to be relatively small so as to reduce a rotational load of the container body 33. In such a case, the drive motor 115 of the body of the image forming apparatus 100 can be reduced in size, resulting in space saving and cost reduction of the image forming apparatus 100.

With reference to FIGS. 4, 7, and 8, the container body 33 of the toner container 32Y according to the present embodiment is integrated such that the leading-end cylindrical portion 33*x* is fitted into an opening of a portion where the plurality of first projections 33*a* and a second projection 33*b* are formed, by thermal fusion or press fitting, for example. In contrast, the entire container body 33 including the leading-end cylindrical portion 33*x* can be manufactured by a single process such as injection molding.

Figure 9A:
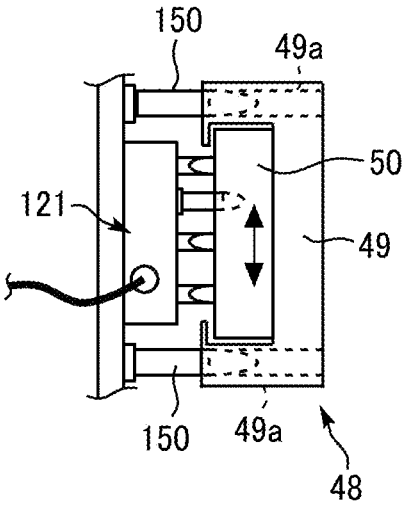
FIG. 9A is an enlarged view of an example of an information storage unit positioned in a body of the image forming apparatus.
Figure 9B:
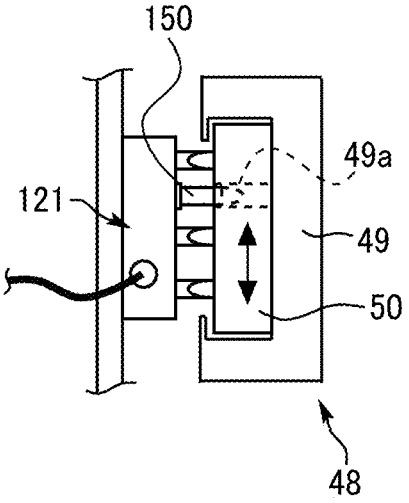
FIG. 9B is an enlarged view of another example of the information storage unit positioned in the body of the image forming apparatus.

With reference to FIG. 4, the toner container 32Y includes an identification (ID) chip 50 serving as an information storage device and a holder 40 to hold the ID chip 50. The ID chip 50 (information storage device) functions so as to be able to communicate with the controller of the body of the image forming apparatus 100 with the toner container 32Y attached to the body of the image forming apparatus 100 (controller). That is, the ID chip 50 exchanges various kinds of data with the controller in the body of the image forming apparatus 100. Specifically, the ID chip 50 stores in advance data such as a manufacturing date, a manufacturing lot number, a color, a toner filling amount, a type of the toner stored in the toner container 32Y and data of the toner container 32Y such as a manufacturing date, a destination, a manufacturing factory, and presence or absence of recycling. When the toner container 32Y is attached to the installation section 31, as illustrated in FIGS. 4, 9A, and 9B, the ID chip 50 contacts a main body terminal 121 of a reading and writing device 120 of the body of the image forming apparatus 100 so as to be able to communicate with the reading and writing device 120. The data stored in the ID chip 50 is read by the reading and writing device 120 and sent to the controller. The data such as usage history of the image forming apparatus 100 is also sent from the controller of the body of the image forming apparatus 100 to the ID chip 50 via the reading and writing device 120 (main body terminal 121), and the data is appropriately stored in the ID chip 50.

The holding portion 40 holds the ID chip 50 at a position closer to a leading edge of the container body 33 (on the left side in FIGS. 4, 7, and 8) in the attaching direction than the gear 37 and is held by the held portion 34 (cap) via the connecting portion 39 (see FIGS. 4, 7, and 8). The connecting portion 39 is coupled to a portion of the held portion 34 (i.e., large-diameter portion 34*a*) in the circumferential direction so as to cover a portion of the gear 37 in a rotation direction. A substantially plate-shaped holding portion 40 is coupled to a leading end of the connecting portion 39 in the attaching direction of the toner container 32Y. In this way, by holding the ID chip 50 in a non-rotating manner at a position closer to the leading edge of the container body 33 than the gear 37 in the attaching direction of the toner container 32Y, the ID chip 50 contacts the main body terminal 121 (see FIG. 9) without being affected by the container body 33 rotating together with the gear 37. Thus, the data is exchanged with the body of the image forming apparatus 100 without trouble. Note that the holding portion 40 is preferably provided with a clearance (recess) for avoiding interference with the gear 37 in order to facilitate assembly of the held portion 34 (integrated with the connecting portion 39 and the holding portion 40) to the container body 33 (in which the gear 37 is installed). A method of holding the ID chip 50 is described later in more detail with reference to FIGS. 6A, 6B. 7, and 8.

Figure 5A:
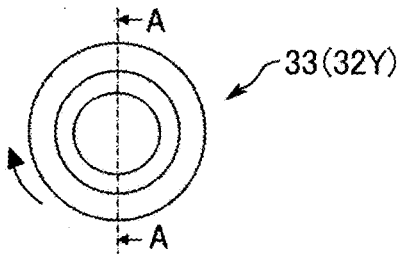
FIG. 5A is a front view of a container body of a toner container.
Figure 5B:
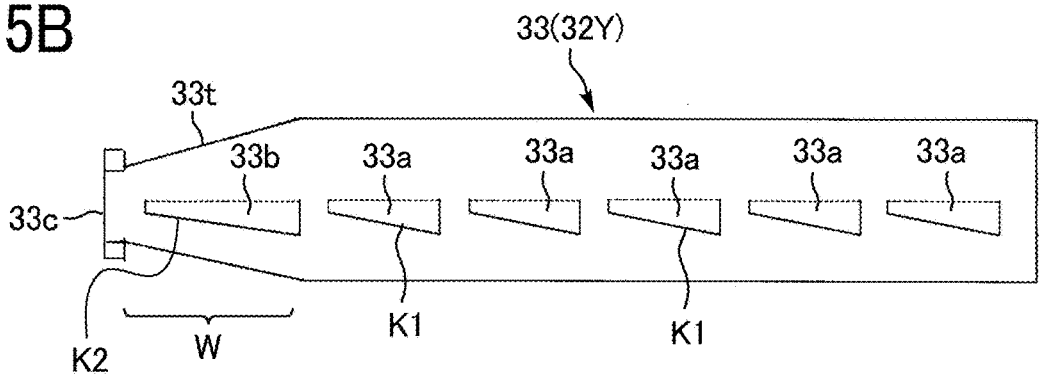
FIG. 5B is a cross-sectional view of the container body of the toner container along a line A-A of FIG. 5A.

With reference to FIGS. 4, 5A, and 5B, in the toner container 32Y according to the present embodiment, the container body 33 has the plurality of first projections 33*a* (groove portions) on the inner circumferential surface of the container body 33 in the attaching direction (in the left and right direction in FIGS. 4 and 5B, and the direction perpendicular to the plane on which FIGS. 5A, 6A and 68 are illustrated). The first projection 33*a* protrudes inward (toward the rotation axis X) of the container body 33 and has a slope K1 inclined with respect to the rotation axis direction. The slope K1 is inclined upward from right to left in FIG. 5B and generates a force to convey toner in the container body 33 to the opening portion 33*c* in conjunction with rotation of the container body 33. When the container body 33 rotates in a predetermined direction (i.e., direction indicated by an arrow in FIG. 5A), the toner stored in the container body 33 is conveyed from a second end of the container body 33 in the rotation axis direction (i.e., right in FIGS. 4 and 5B) to the first end of the container body 33 in the rotation axis direction (i.e., left in FIGS. 4 and 5B) by the plurality of first projections 33*a* having such a configuration as described above.

In particular, in the present embodiment, as illustrated in FIG. 5B, the plurality of first projections 33*a* are disposed at substantially the same position in the rotation direction when viewed in a cross section orthogonal to the rotation axis direction. In the present embodiment, the first projection 33*a* is formed in a groove shape so as to protrude inward from the outer circumferential surface of the container body 33. In the present embodiment, the five first projections 33*a* are disposed in a portion excluding a conical portion 33*t* of the container body 33 (a mortar-shaped area W near the opening portion 33*c*, see FIG. 5B). In addition to the five first projections 33*a*, the second projection 33*b* is formed in the vicinity of the opening portion 33*c* in the container body 33 in the present embodiment, which is described in detail later.

Such a plurality of first projections 33*a* can reduce a problem that the storable toner capacity is reduced. For example, in a conventional toner container in which a spiral groove (first projection) is provided on the circumferential surface of the container body, the internal volume of the container body is reduced by an amount of the groove, and the toner capacity that can be stored is reduced. In contrast, in the present embodiment, a spiral groove is not formed in the entire area in the rotation direction of the container body 33, but the plurality of first projections 33*a* (groove portions) are formed only in a part in the rotation direction of the container body 33. Thus, the percentage of the projection protruding inward of the container body 33 is decreased. The toner capacity that can be stored increases compared to a case of forming a spiral groove for the container body having the same inner diameter.

In the present embodiment, the container body 33 includes the second projection 33*b* at a position shifted from the opening portion 33*c* toward the second end in the rotation axis direction. The second projection 33*b* is disposed on the inner circumferential surface (i.e., the inner circumferential surface in the area W in FIG. 5B) at a position shifted from the plurality of first projections 33*a* toward the first end of the container body 33 in the rotation axis direction. The second projection 33*b* has a slope K2 protruding inward and inclined with respect to the rotation axis direction. The second projection 33*b* conveys the toner conveyed in the rotation axis direction by the plurality of first projections 33*a* while scooping up the toner toward the opening portion 33*c*. Since the inclination angle of the slope K2 of the second projection 33*b* is smaller than the inclination angle of the slope K1 of the first projection 33*a*, a conveyance force in the rotation axis direction is reduced, thus facilitating a toner scooping force to act on the toner.

In the present embodiment, the container body 33 is formed such that the inner diameter of the inner circumferential surface gradually decreases from a position closer to the first end in the rotation axis direction than the plurality of first projections 33*a* to the opening portion 33*c* (the area W in FIG. 5B). Specifically, the container body 33 (a portion excluding the leading-end cylindrical portion 33*x*) is formed such that a portion other than the area W (a portion where the first projection 33*a* is provided) has substantially the same diameters. The mortar-shaped conical portion 33*t* is formed in the area W. By providing the conical portion 33*t* in this manner, the toner conveyed in the rotation axis direction by the plurality of first projections 33*a* is smoothly scooped up toward the opening portion 33*c* and is smoothly discharged from the opening portion 33*c* to the outside. In particular, in the present embodiment, since the second projection 33*b* is provided on the conical portion 33*t*, smooth scooping of toner toward the opening portion 33*c* and smooth discharge of toner from the opening portion 33*c* to the outside are expedited.

With reference to FIGS. 6A and 6B, the ID chip 50, the holding portion 40, and the connecting portion 39 are disposed at oblique positions (positions on a long dashed short dashed line Q (inclined line passing through the rotation axis X in FIG. 6A) excluding positions on a horizontal line S and a vertical line R passing through the rotation axis X when viewed in a cross section orthogonal to the rotation axis X in a state where toner container 32Y is attached to the body of the image forming apparatus 100 (installation section 31). That is, the ID chip 50, the holding portion 40, and the connecting portion 39 are obliquely disposed at positions excluding a top portion, a bottom portion, and both side portions of the held portion 34 when viewed in a cross section orthogonal to the rotation axis X.

More specifically, with reference to FIGS. 6A and 61, the ID chip 50, the holding portion 40, and the connecting portion 39 are disposed so as to protrude in an oblique direction around the rotation axis X from the outer circumferential surface of the held portion 34 (large-diameter portion 34*a*) when viewed in a cross section orthogonal to the rotation axis X in a state where the toner container 32Y is attached to the body of the image forming apparatus 100. That is, as illustrated in FIG. 6A, the ID chip 50, the holding portion 40, and the connecting portion 39 are disposed so as to protrude in the direction of the long dashed short dashed line Q with respect to the held portion 34.

As described above, the toner container 32Y in the present embodiment is formed such that most parts of the leading end of the container body 33 in the attaching direction are not covered with the held portion 34, but most parts of the leading end of the container body 33 in the attaching direction (vicinity of the gear 37) is exposed except for the position of the connecting portion 39. Accordingly, the condition of the joint portion of the gear 37 disposed on the leading end of the container body 33 in the attaching direction or the condition of the junction portion of the leading-end cylindrical portion 33*x* of the container body 33 (the condition of assembly or components themselves) are easy to visually recognize. Therefore, an assembly failure or a component failure of the toner container 32Y (the container body 33) is easy to detect, thus facilitating handling of the failure.

Figure 10A:
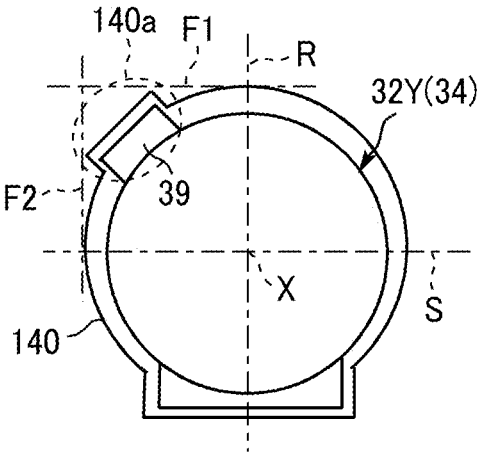
FIG. 10A is a diagram illustrating an example of a relationship between the toner container and an inlet port of the body of the image forming apparatus.
Figure 10B:
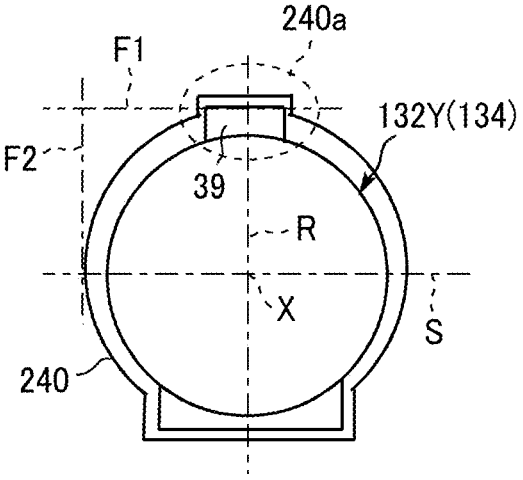
FIG. 10B is a diagram illustrating another example of a relationship between the toner container and the inlet port of the body of the image forming apparatus.

As illustrated in FIGS. 6A, 6B, and 10A, the ID chip 50, the holding portion 40, and the connecting portion 39 are disposed in an oblique direction in the toner container 32Y according to the present embodiment so that a space for attaching the toner container 32Y in the image forming apparatus 100 (installation section 31) can be effectively utilized as compared with a case where the ID chip 50, the holding portion 40, and the connecting portion 39 are disposed at the top portion (as illustrated in FIG. 10B), or the bottom portion, or the side portion. Specifically, as a toner container 132Y (a held portion 134) illustrated as a comparative example in FIG. 10B, in a case where the ID chip 50, the holding portion 40, and the connecting portion 39 are disposed at the top portion (or bottom portion, or side portion), the clearance (recess) for avoiding interference between the ID chip 50, the holding portion 40, and the connecting portion 39 is necessary so as to protrude outward from a virtual tangent F t passing through the top portion (or a virtual tangent passing through the bottom portion, or a virtual tangent F2 passing through the side portion) of a circular portion of an inlet 240 in the body of the image forming apparatus 100. The body of the image forming apparatus 100 has the inlet 240 on the trailing end side of the container body 33 in the attaching direction to attach and detach the toner container 32Y. Accordingly, an extra space to attach the toner container 32Y to the image forming apparatus 100 (installation section 31) needs to be secured in an upper area (or a lower area or a lateral side area) in the image forming apparatus 10 (installation section 31). On the other hand, in the present embodiment, as illustrated in FIG. 10A, since the ID chip 50, the holding portion 40, and the connecting portion 39 are disposed in an oblique direction, the clearance (recess) for avoiding interference between the ID chip 50, the holding portion 40, and the connecting portion 39 can be formed in an area surrounded by the two virtual tangents F1 and F2, passing through the top portion and the side portion, respectively, of a circular portion of an inlet 140. For this reason, a space for attaching the toner container 32Y is less likely to expand in the vertical direction and the lateral direction (i.e., left and right direction) in the image forming apparatus 100 (installation section 31), and the image forming apparatus 100 is less likely to increase in size. In particular, such a configuration is useful in a case where a plurality of toner containers is disposed in parallel in a horizontal direction or a vertical direction.

As illustrated in FIGS. 7 and 8, the toner container 32Y according to the present embodiment has the connecting portion 39 that covers a part of the gear 37 in the rotation direction. The connecting portion 39 has a rib-shaped portion 39*b* (reinforcing member) that connects the held portion 34 and the holding portion 40. Specifically, the connecting portion 39 has a plate-shaped portion 39*a* extending from the held portion 34 toward the leading edge of the container body 33 in the attaching direction (i.e., left in FIGS. 7 and 8). The plate-shaped portion 39*a* (connecting portion 39) extends from the large-diameter portion 34*a* of the held portion 34 toward the leading edge of the container body 33 in the attaching direction without contacting the gear 37. The connecting portion 39 is formed such that its width (a vertical length in FIG. 7 or a vertical length in FIG. 8) gradually decreases from a root portion (a portion connected to the large-diameter portion 34*a*) to a predetermined area on the leading end of the container body 33 in the attaching direction. When the width exceeds the predetermined area, the connecting portion 39 has a constant width up to a leading end (a portion coupled to the holding portion 40). The rib-shaped portion 39*b* extends in the attaching and detaching directions (i.e., left and right directions in FIGS. 7 and 8) on the plate-shaped portion 39*a*. Specifically, as illustrated in FIGS. 6A and 6B, the holding portion 40 protrudes in the radial direction with respect to the large-diameter portion 34*a* when viewed in a cross section orthogonal to the rotation axis X. The rib-shaped portion 39*b* is coupled to a protruding part of the holding portion 40. As illustrated in FIG. 8, the connecting portion 39 has a plurality of rib-shaped portions 39*b* (two rib-shaped portions 39*b* in the present embodiment) disposed in parallel with each other at intervals in a direction (i.e., vertical direction in FIG. 8) orthogonal to the attaching and detaching directions.

The reason why the rib-shaped portion 39*b* is provided with the connecting portion 39 is that, in a case where the held portion 34 is formed so that most of the gear 37 is exposed as described above, the ID chip 50 (holding portion 40) is held via the connecting portion 39 having a narrow width, and thus the strength of the portion holding the ID chip 50 is weakened. In a case where the strength of the portion holding the ID chip 50 is weakened, the positional accuracy of the ID chip 50 with respect to the body of the image forming apparatus 100 (main body terminal 121) is lowered. Thus, a problem such as a communication failure with the body of the image forming apparatus 100 is likely to occur. In contrast, in the present embodiment, since the rib-shaped portion 39*b* is disposed in the connecting portion 39, the strength of the portion holding the ID chip 50 is reinforced, and the above-described problem is less likely to occur. That is, the positional accuracy of the ID chip 50 is not lowered, and the condition of a member (such as the gear 37) disposed on the leading end of the container body 33 in the attaching direction of the toner container 32 is easy to check.

As illustrated in FIG. 8, an opening 39*al* through which the gear 37 can be visually recognized from the outside is formed on the plate-shaped portion 39*a* of the connecting portion 39. Thus, the condition of the gear 37 and its vicinity is further easy to check. In the present embodiment, the two rib-shaped portions 39*b* (the plurality of rib-shaped portions) are formed so as to interpose the opening 39*a*1. Accordingly, even if the opening 39*al* is disposed, the two rib-shaped portions 39*b* efficiently reinforce the strength of the connecting portion 39.

As illustrated in FIGS. 7 and 8, in the present embodiment, the ID chip 50 as an information storage device has a substantially flat-plate shape. The holding portion 40 holds the ID chip 50 such that a plate surface of the ID chip 50 (a substrate surface on which terminals in contact with the main body terminals 121 are exposed) is substantially orthogonal to the attaching and detaching directions. That is, the ID chip 50 is disposed such that the substrate surface extends in the vertical direction in FIGS. 7 and 8. With such a configuration, the ID chip 50 can be smoothly connected to and disconnected from the main body terminal 121 (see FIG. 9) in conjunction with the attaching and detaching operations of the toner container 32Y to and from the body of the image forming apparatus 100.

In the present embodiment, the holding portion 40, the connecting portion 39, and the held portion 34 are integrated as one component. An ID chip unit 48 (serving as an information storage unit) in which the ID chip 50 is integrated is detachably attached on the integrated held portion 34 (with the holding portion 40 and the connecting portion 39). Specifically, with reference to FIGS. 7, 8, 9A, and 9B, the ID chip unit 48 (information storage unit) mainly includes the ID chip 50 and an ID chip case 49 to hold the ID chip 50. The ID chip case 49 is formed of highly rigid insulating material to reduce mechanical damage and electrical damage to the ID chip 50. The ID chip unit 48 is detachably attached on an installation surface of the holding portion 40 by click clamping or screw fastening. The held portion 34 has the large-diameter portion 34*a* having an outer diameter larger than an outer diameter of the gear 37. The holding portion 40 protrudes in the radial direction with respect to the large-diameter portion 34*a* when viewed in a cross section orthogonal to the rotation axis X. The plurality of rib-shaped portions 39*b* are coupled to the protruding part of the holding portion 40. The plurality of rib-shaped portions 39*b* extends in the attaching and detaching directions. The maximum interval between the rib-shaped portions 39*b* at both ends among the plurality of rib-shaped portions 39*b* is smaller than the width of the ID chip unit 48 in the direction orthogonal to the attaching and detaching directions. With such a configuration, the ID chip 50 (ID chip unit 48) is detachably attached so that replacement and maintenance of the ID chip 50 can be easily performed.

With reference to FIG. 9A, in the present embodiment, the ID chip case 49 of the ID chip unit 48 has a through-hole 49*a* that fits a positioning pin 150 disposed in the body of the image forming apparatus 100. The holding portion 40 holds the ID chip unit 48 so as to be movable in directions orthogonal to the attaching and detaching directions (i.e., directions indicated by a double-headed arrow in FIGS. 9A and 9B or a direction perpendicular to the plane on which FIGS. 9A and 9B are illustrated). Specifically, the ID chip case 49 is fixed to the holding portion 40. The ID chip 50 is movable (slidable) in the directions orthogonal to the attaching and detaching directions and loosely held in the ID chip case 49 so as not to fall off or tilt significantly. With such a configuration, even if the positional accuracy (the positional accuracy in the directions orthogonal to the attaching and detaching directions) of the ID chip 50 with respect to the main body terminal 121 is lowered due to the component accuracy or assembly accuracy of all components related to the attachment of the toner container 32Y to the body of the image forming apparatus 100, the ID chip 50 moves so as to correct the position in the ID chip case 49 (ID chip unit 48), thereby preventing contact failure (communication failure) between the main body terminal 121 and the ID chip 50.

In the present embodiment, as illustrated in FIG. 9A, the positioning pin 150 is directly disposed on the side plate of the body of the image forming apparatus 100, and the through-hole 49*a* is formed in the ID chip case 49. The positions of the positioning pin 150 and the through-hole 49*a* are not limited to this. For example, as illustrated in FIG. 9B, the positioning pin 150 may be disposed on the main body terminal 121 of the image forming apparatus 100, and the through-hole 49*a* may be formed in the ID chip 50 itself. In such a case, in order to increase the positional accuracy of the ID chip 50 with respect to the main body terminal 121, it is preferable that the through-hole 49*a* is positioned between the rib-shaped portion 39*b* and the rib-shaped portion 39*b* among the plurality of rib-shaped portions 39*b* in directions orthogonal to the attaching and detaching directions (i.e., directions indicated by a double-headed arrow in FIG. 9B, and directions in which the plurality of rib-shaped portions 39*b* are arranged). In the ID chip unit 48, a fitted portion fitted to the positioning pin IS (fitting portion) is not limited to the through-hole 49*a*. For example, the fitted portion may have a shape in which the positioning pin 150 is fitted (nipped) so as to straddle the ID chip 50 and the ID chip case 49. In the present embodiment, with reference to FIG. 9A, the ID chip 5) is loosely held on the ID chip case 49 so as to be movable (slidable) in the directions orthogonal to the attaching and detaching directions. In contrast, the ID chip case 49 in which the ID chip 50 is tightly held may be movable (slidable) in the directions orthogonal to the attaching and detaching directions and loosely held in the holding portion 40 (see FIG. 7) so as not to fall off or tilt significantly. Also in such a case, contact failure (communication failure) between the main body terminal 121 and the ID chip 50 can be prevented similar to the configuration of the present embodiment.

First Modification

Figure 11:
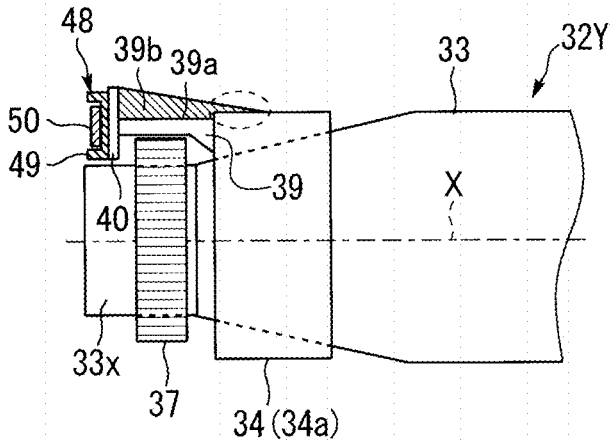
FIG. 11 is a view of a main part of a toner container from a direction orthogonal to an oblique direction to a rotation axis direction in a first modification.

As illustrated in FIG. 11, the toner container 32Y according to a first modification, similarly to the configuration illustrated in FIG. 7, has the holding portion 40 protruding in the radial direction with respect to the large-diameter portion 34*a*, and has the rib-shaped portions 39*b* coupled to the protruding part of the holding portion 40. In the first modification, each of the rib-shaped portions 39*b* is formed such that the length protruding in the radial direction gradually increases from the held portion 34 toward the leading edge of the container body 33 in the attaching direction. That is, as illustrated in FIG. 11, the rib-shaped portion 39*b* in the first modification has a substantially triangular shape. Such a configuration efficiently reinforces the strength of the portion holding the ID chip 50 without unnecessarily forming corner portions on the toner container 32Y. The strength of the connecting portion between the holding portion 40 and the connecting portion 39 is reinforced. A problem that the rib-shaped portion 39*b* is caught by the inlet 140 (see FIG. 10A) of the body of the image forming apparatus 100 when the toner container 32Y is pulled out from the installation section 31 is reduced. In the first modification, as illustrated in FIG. 11, the rib-shaped portion 39*b* extends to the holding portion 40 from a position (overlapping position) where the rib-shaped portion 39*b* overlaps the held portion 34 in the attaching and detaching directions. That is, when viewed in the attaching and detaching directions, the rib-shaped portion 39*b* does not extend from an end surface of the held portion 34 on the leading end of the container body 33 in the attaching direction toward the leading edge of the container body 33 in the attaching direction. The rib-shaped portion 39*b* extends from a position closer to a trailing end of the container body 33 in the attaching direction than the end surface of the held portion 34 on the leading end of the container body 33 in the attaching direction toward the leading edge of the container body 33 in the attaching direction. In other words, when viewed in the attaching and detaching directions, the rib-shaped portion 39*b* overlaps the held portion 34 in a portion surrounded by a broken line in FIG. 11. With reference to FIG. 11, the toner container 32Y (container body 33) has the opening portion 33*c* (see FIG. 3) on the leading edge of the container body 33 in the attaching direction, and the conical portion (conical surface) whose inner diameter gradually decreases toward the opening portion 33*c* on the leading edge of the container body 33 in the attaching direction (see the area W in FIG. 5B). The held portion 34 is disposed so as to cover a part (or all) of the conical portion. As illustrated in FIG. 11, in the attaching and detaching directions, the rib-shaped portion 39*b* is located between the opening portion 33*c* and a trailing end of the conical portion in the attaching direction. With such a configuration, the mechanical strength of the portion (root portion) where the rib-shaped portion 39*b* is coupled to the held portion 34 is increased. Thus, the rib-shaped portion 39*b* itself is less likely to be deformed, and thus the positional accuracy of the ID chip 50 can be increased.

Second Modification

Figure 12:
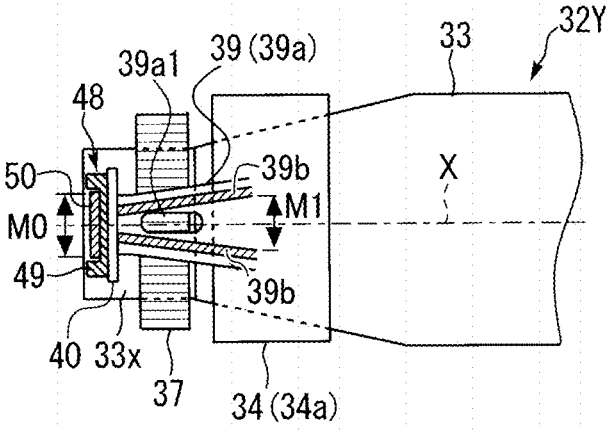
FIG. 12 is a view of a main part of a toner container from an oblique direction to a rotation axis direction in a second modification.

As illustrated in FIG. 12, in the connecting portion 39 of the toner container 32Y according to a second modification, the two rib-shaped portions 39*b* (a plurality of rib-shaped portions) are arranged side by side at intervals in directions (vertical directions in FIG. 8) orthogonal to the attaching and detaching directions, similar to the configuration illustrated in FIG. 8. In the second modification, the two rib-shaped portions 39*b*(the plurality of rib-shaped portions) are formed such that the interval between the adjacent rib-shaped portions gradually decreases toward the leading edge of the container body 33 in the attaching direction. That is, as illustrated in FIG. 12, the two rib-shaped portions 39*b* are arranged in an inverted V-shape. With such a configuration, the connecting portion 39 whose root portion is formed in the inverted V-shape is efficiently reinforced. With reference to FIG. 12, the plurality of rib-shaped portions 39*b* (including a case where three or more rib-shaped portions 39*b* are arranged side by side) are preferably formed such that a maximum interval M1 between the rib-shaped portions 39*b* at both ends among the plurality of rib-shaped portions 39*b* is smaller than the width of the holding portion 40 in the directions orthogonal to the attaching and detaching directions. In particular, the maximum interval M1 between the rib-shaped portions 39*b* at both ends among the plurality of rib-shaped portions 39*b* is preferably smaller than the width of the ID chip 50 in the directions orthogonal to the attaching and detaching directions. Specifically, in the second modification, as illustrated in FIG. 12, the two rib-shaped portions 39*b* are formed such that the maximum interval M1 (which is the interval between root portions) is smaller than a width M of the ID chip 50 in the directions orthogonal to the attaching and detaching directions (M1<M0). With such a configuration, the strength of the connecting portion 39 is efficiently reinforced without unnecessarily increasing the width of the connecting portion 39. Also in the second modification, the rib-shaped portion 39*b* extends to the holding portion 40 from a position where the rib-shaped portion 39*b* overlaps the held portion 34 in the attaching and detaching directions, similar to the configuration in the first modification. Accordingly, the positional accuracy of the ID chip 50 can be increased.

As described above, the toner container according to the present embodiment is the toner container 32Y that is detachably attached to the body of the image forming apparatus 100 in the predetermined attaching and detaching directions. The toner container 32Y includes the container body 33 and the gear 37. The container body 33 is rotatable around the rotation axis X. The gear 37 is disposed on the leading end of the container body 33 in the attaching direction of the toner container 32Y in the attaching and detaching directions and is rotatable together with the container body 33. The toner container 32Y includes the held portion 34 that is held by the body of the image forming apparatus 100 in a non-rotatable manner so as to cover a part of the container body 33 and such that the gear 37 is exposed on the leading end of the container body 33 in the attaching direction of the toner container 32Y. The toner container 32Y includes the ID chip 50 and the holding portion 40. The ID chip 50 is capable of communicating with the body of the image forming apparatus 100 in a state where the toner container 32Y is attached to the body of the image forming apparatus 100. The holding portion 40 holds the ID chip 50 at a position closer to the leading edge of the container body 33 than the gear 37 in the attaching direction and is held by the held portion 34 via the connecting portion 39. When viewed in a cross section orthogonal to the rotation axis X in a state where the toner container 32Y is attached to the body of the image forming apparatus 10, the ID chip 50, the holding portion 40, and the connecting portion 39 are disposed at oblique positions excluding positions on a horizontal line S and a vertical line R passing through the rotation axis X. The connecting portion 39 covers a part of the gear 37 in the rotation direction and has the rib-shaped portion 39*b* to connect the held portion 34 and the holding portion 40. As a result, the positional accuracy of the ID chip 50 is not lowered, and the condition of a member disposed on the leading end of the container body 33 in the attaching direction of the toner container 32Y is easy to check.

In the present embodiment, toner (e.g., a one-component developer) is stored in the toner container 32Y but an object to be stored in the toner container is not limited to this. For example, in some embodiments of the present disclosure, a two-component developer may be stored in a toner container. Even such a case exhibits substantially the same advantages as the advantages of the above-described embodiments.

Note that embodiments of the present disclosure are not limited to the above-described embodiments, and it is apparent that the above-described embodiments can be appropriately modified within the scope of the technical idea of the present disclosure in addition to what is suggested in the above-described embodiments. The number, position, and shape of the components described above are not limited to those embodiments described above. Desirable number, position, and shape can be determined to perform the present disclosure. Such variations are not to be regarded as a departure from the scope of the present disclosure and appended claims, and all such modifications are intended to be included within the scope of the present disclosure and appended claims.

The invention claimed is:

1. A toner container that is attachable in an attaching direction and detachable in a detaching direction, the toner container comprising:

a container body rotatable around a rotation axis;

a gear disposed on a leading end of the container body in the attaching direction of the toner container, the gear being rotatable together with the container body;

a held portion covering a part of the container body, the held portion being disposed such that the gear is exposed on the leading end in the attaching direction, the held portion configured to be held in a non-rotating manner;

a memory to store information which is to be communicated in a state where the toner container is attached;

a holder to hold the memory at a position closer to a leading edge of the toner container than the gear in the attaching direction; and a connector via which the holder is held by the held portion, wherein the memory, the holder, and the connector are disposed at oblique positions excluding positions on a horizontal line and a vertical line passing through the rotation axis when viewed in a cross section orthogonal to the rotation axis in the state where the toner container is attached, and wherein the connector covers a part of the gear in a rotation direction of the gear and includes a rib-shaped portion that connects the held portion and the holder, wherein the connector includes a plate-shaped portion extending from the held portion toward the leading edge of the toner container in the attaching direction, and wherein the rib-shaped portion extends in the attaching direction on the plate-shaped portion.

2. The toner container according to claim 1, wherein the memory, the holder, and the connector protrude in an oblique direction relative to the rotation axis beyond an outer circumferential surface of the held portion when viewed in the cross section orthogonal to the rotation axis in the state where the toner container is attached.

3. The toner container according to claim 1, wherein the plate-shaped portion has an opening through which the gear is visible from outside of the toner container, and wherein the connector includes a plurality of rib-shaped portions, including the rib-shaped portion, that connect the held portion and the holder and interpose the opening between the plurality of rib-shaped portions.

4. The toner container according to claim 1, wherein the held portion includes a large-diameter portion having an outer diameter larger than an outer diameter of the gear, wherein the plate-shaped portion extends from the large-diameter portion toward the leading edge of the toner container in the attaching direction without contacting the gear, wherein the holder has a protruding part protruding in a radial direction with respect to the large-diameter portion when viewed in the cross section orthogonal to the rotation axis, and wherein the rib-shaped portion couples to the protruding part of the holder.

5. The toner container according to claim 4, wherein a length of the rib-shaped portion protruding in the radial direction gradually increases from the held portion toward the leading edge of the toner container in the attaching direction.

6. The toner container according to claim 1, wherein the connector has a plurality of rib-shaped portions disposed in parallel with each other at an interval in a direction orthogonal to the attaching direction.

7. The toner container according to claim 1, wherein the memory has a substantially flat-plate shape, and wherein the holder holds the memory such that a plate surface of the memory is substantially orthogonal to the attaching direction.

8. The toner container according to claim 1, further comprising:

an opening portion disposed on the leading end of the toner container in the attaching direction; and a conical portion whose inner diameter gradually decreases toward the opening portion, the conical portion being disposed on the leading end of the toner container in the attaching direction, wherein the held portion covers at least a part of the conical portion, and wherein the rib-shaped portion is disposed between the opening portion and a trailing end of the conical portion in the attaching direction.

9. The toner container according to claim 1, wherein the rib-shaped portion extends to the holder from a position where the rib-shaped portion overlaps the held portion in the attaching direction.

10. The toner container according to claim 1, wherein the leading end extends from the leading edge of the toner container in the attaching direction of the toner container to the part of the container body covered by the held portion.

11. An image forming apparatus comprising:

the toner container according to claim 1; and a body, wherein the toner container is detachably attached to the body.

12. A toner container that is attachable in an attaching direction and detachable in a detaching direction, the toner container comprising:

a container body rotatable around a rotation axis;

a gear disposed on a leading end of the container body in the attaching direction, the gear being rotatable together with the container body;

a held portion covering a part of the container body, the held portion being disposed such that the gear is exposed on the leading end in the attaching direction, the held portion configured to be held in a non-rotating manner;

a memory to store information which is to be communicated in a state where the toner container is attached;

a holder to hold the memory at a position closer to a leading edge of the toner container than the gear in the attaching direction; and a connector via which the holder is held by the held portion, wherein the memory, the holder, and the connector are disposed at oblique positions excluding positions on a horizontal line and a vertical line passing through the rotation axis when viewed in a cross section orthogonal to the rotation axis in the state where the toner container is attached, and wherein the connector covers a part of the gear in a rotation direction of the gear and includes a rib-shaped portion that connects the held portion and the holder, wherein the connector includes a plate-shaped portion extending from the held portion toward the leading edge of the toner container in the attaching direction, and wherein the rib-shaped portion extends in the attaching direction on the plate-shaped portion, wherein the connector has a plurality of rib-shaped portions disposed in parallel with each other at an interval in a direction orthogonal to the attaching direction, and wherein an interval between adjacent ones of the plurality of rib-shaped portions gradually decreases toward the leading edge of the toner container in the attaching direction.

13. The toner container according to claim 12, wherein a maximum interval between the rib-shaped portions at both ends in the direction orthogonal to the attaching direction, among the plurality of the rib-shaped portions, is smaller than a width of the holder in the direction orthogonal to the attaching direction.

14. The toner container according to claim 13, wherein the maximum interval is smaller than a width of the memory in the direction orthogonal to the attaching direction.

15. A toner container that is attachable in an attaching direction and detachable in a detaching direction, the toner container comprising:

a container body rotatable around a rotation axis;

a gear disposed on a leading end of the container body in the attaching direction, the gear being rotatable together with the container body;

a held portion covering a part of the container body, the held portion being disposed such that the gear is exposed on the leading end in the attaching direction, the held portion configured to be held in a non-rotating manner;

a memory to store information which is to be communicated in a state where the toner container is attached;

a holder to hold the memory at a position closer to a leading edge of the toner container than the gear in the attaching direction; and a connector via which the holder is held by the held portion, wherein the memory, the holder, and the connector are disposed at oblique positions excluding positions on a horizontal line and a vertical line passing through the rotation axis when viewed in a cross section orthogonal to the rotation axis in the state where the toner container is attached, and wherein the connector covers a part of the gear in a rotation direction of the gear and includes a rib-shaped portion that connects the held portion and the holder, wherein the connector includes a plate-shaped portion extending from the held portion toward the leading edge of the toner container in the attaching direction, and wherein the rib-shaped portion extends in the attaching direction on the plate-shaped portion, wherein the holder, the connector, and the held portion are integrated as one component, the holder holds the memory indirectly, and an information storage unit assembled with the memory is detachably attached and is held by the holder of the one component, wherein the held portion includes a large-diameter portion having an outer diameter larger than an outer diameter of the gear, wherein the holder protrudes in a radial direction with respect to the large-diameter portion when viewed in a cross section orthogonal to the rotation axis, wherein a plurality of rib-shaped portions including the rib-shaped portion coupled to a protruding portion of the holder, and wherein the plurality of rib-shaped portions extend in the attaching direction, and a maximum interval between the rib-shaped portions at both ends in the direction orthogonal to the attaching direction, among the plurality of rib-shaped portions, is smaller than a width of the holder in the direction orthogonal to the attaching direction.

16. The toner container according to claim 15, wherein the information storage unit has a through-hole to fit a positioning pin, wherein the holder holds the information storage unit such that the information storage unit is movable in the direction orthogonal to the attaching direction, and wherein the through-hole is positioned between two rib-shaped portions among the plurality of rib-shaped portions in the direction orthogonal to the attaching direction.

* * * * *